US008615913B1

(12) United States Patent
Hunsucker

(10) Patent No.: US 8,615,913 B1
(45) Date of Patent: Dec. 31, 2013

(54) SIGN SYSTEM FOR MOUNTING A SIGN

(76) Inventor: Tom Hunsucker, Rancho Cucamonga, CA (US)

( * ) Notice: Subject to any disclaimer, the term of this patent is extended or adjusted under 35 U.S.C. 154(b) by 0 days.

(21) Appl. No.: 13/204,859

(22) Filed: Aug. 8, 2011

Related U.S. Application Data

(60) Provisional application No. 61/371,873, filed on Aug. 9, 2010.

(51) Int. Cl.
*G09F 3/18* (2006.01)

(52) U.S. Cl.
USPC ..... 40/594; 40/661.09

(58) Field of Classification Search
USPC ..... 40/594, 607.12, 607.14, 665, 538, 539, 40/607.13, 661.09, 760, 306, 310, 316, 40/611.12; 248/682, 683; 24/304, 457
See application file for complete search history.

(56) References Cited

U.S. PATENT DOCUMENTS 2,262,873 A * 11/1941 Wise ..... 40/607.12
5,154,392 A * 10/1992 Voight ..... 248/558
5,212,898 A * 5/1993 Dinan et al. ..... 40/607.12
5,704,144 A * 1/1998 Groth ..... 40/306

* cited by examiner

*Primary Examiner* — Joanne Silbermann

(57) ABSTRACT

A sign system includes a sign member and a mounting member. The sign member is configured to be used as a display for displaying words, graphics, etc. In this regard, the sign member has a front surface on which the words or graphics can be displayed. In an embodiment, the sign member is made of a material that is rigid or substantially rigid such that the sign member 105 can maintain its shape on its own. The mounting member is at least partially made of a flexible material that can conform to a display post of various shapes.

8 Claims, 3 Drawing Sheets

SIGN SYSTEM FOR MOUNTING A SIGN

REFERENCE TO PRIORITY DOCUMENT

This application claims priority of U.S. Provisional Patent Application Ser. No. 61/371,873 entitled SIGN SYSTEM and filed on Aug. 9, 2010. The disclosure of the Provisional Patent Application is hereby incorporated by reference in its entirety.

BACKGROUND

The present disclosure relates to signage devices. In particular, the present disclosure related to a system for mounting signs on objects.

There is often a need to post or mount a sign on an object for display, such as on a post. For example, any of a variety of entities may have the need to mount a sign on a random object for display, such as an advertisement sign, garage sale sign, for-sale sign, etc. Often, the user will try to mount the sign on an vertically-extending object, such as a post. The vertically-extending object on which the sign is mounted can vary in size and shape, which can make it difficult to easily and quickly mount the sign. For example, users will often want to mount the sign on a cylindrical post, tree, fence, etc. wherein the object has an irregular shape. In situations where the sign is rectangular and rigid, it can be difficult to mount the rectangular, rigid sign on a vertical, cylindrical post. As a result, a user will simply use a non-rigid object, such as soft cardboard or paper, for the sign, and then wrap the non-rigid object around the post.

Such an arrangement can be unattractive and unwieldy. As a result, the sign that is intended to attract viewers can often end up turning off a viewer due to the unprofessional look of the sign. In view of the foregoing, there is a need for a system for easily and quickly mounting a sign onto an object of any shape or contour.

SUMMARY

Disclosed is a signage system that is configured to be easily and conveniently mounted on a vertically-extending object, such as a post or tree, whether the object is flat or of irregular shape. The system can be easily mounted even if the vertically-extending object is of irregular shape. Moreover, the disclosed sign system does not require users to carry mounting devices, such as tape, scissors, hammers and nails, in order to mount the sign system. The sign system also renders a mounted sign easy to read when the surface of the sign is perpendicular or normal to the vertical axis on which it is mounted.

In one aspect, there is disclosed a sign system, comprising: a sign member formed of a rigid material of relatively fixed shape, wherein the sign member has a front surface for display of a sign and a back surface; and a mounting member attached to the back surface of the sign member, wherein the mounting member is formed of a material of conformable shape, and wherein at least a portion of the mounting member comprises adhesive.

Other features and advantages should be apparent from the following description of various embodiments, which illustrate, by way of example, the principles of the invention.

BRIEF DESCRIPTION OF THE DRAWINGS

These and other aspects will now be described in detail with reference to the following drawings.

DETAILED DESCRIPTION

Before the present subject matter is further described, it is to be understood that this subject matter described herein is not limited to particular embodiments described, as such may of course vary. It is also to be understood that the terminology used herein is for the purpose of describing particular embodiments only, and is not intended to be limiting. Unless defined otherwise, all technical terms used herein have the same meaning as commonly understood by one skilled in the art to which this subject matter belongs.

Figure 1:
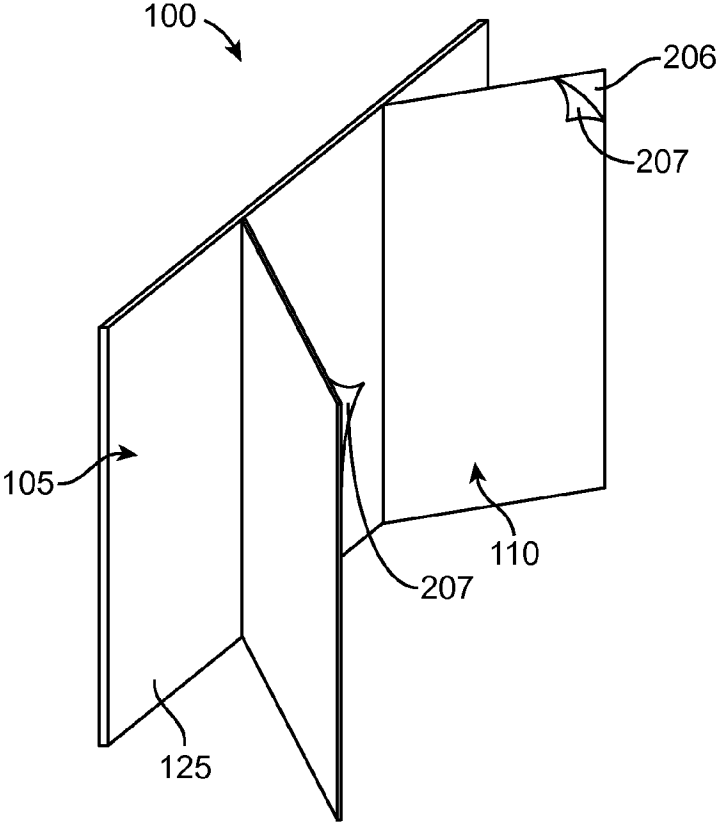
FIG. 1 shows a first embodiment of a sign system.

FIG. 1 shows a first embodiment of a sign system 100 that includes a sign member 105 and a mounting member 110. The sign member 105 is configured to be used as a display for displaying words, graphics, etc. In this regard, the sign member 105 has a front surface on which the words or graphics can be displayed. In an embodiment, the sign member 105 is made of a material that is rigid or substantially rigid such that the sign member 105 can maintain its shape on its own even when exposed to the forces of gravity. The sign member 105 can be made of any of a variety of materials including cardboard, plastic, metal (including steel), or any material that has sufficient rigidity to maintain its shape. The sign member 105 is shown in FIG. 1 as being rectangular although it can have any of a variety of shapes and sizes adapted to display the desired graphics or words.

Figure 2:
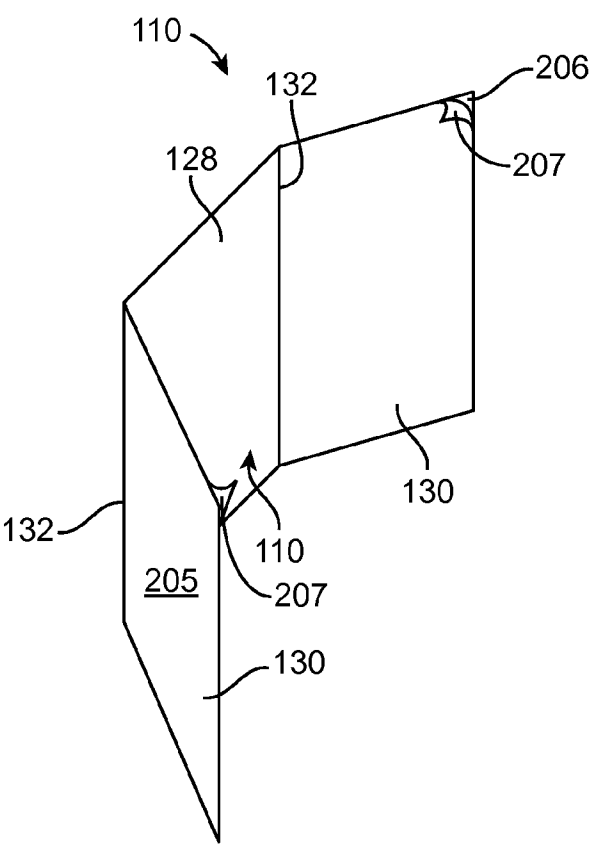
FIG. 2 shows a mounting member of the sign system of FIG. 1.

FIG. 2 shows the mounting member 110, which is attached or attachable to a back surface 125 of the sign member 105. In an embodiment, the mounting member 110 is fixedly attached to the back surface 125 such that the sign member 105 and mounting member 110 are integrally formed. In another embodiment, the mounting member has a front surface on which at least a portion has adhesive. The adhesive front surface of the mounting member 110 can be positioned in juxtaposition with the back surface of a sign member 105 and then adhered to the sign member 105. This permits any sign member 105 to be converted to a sign system of the type described herein.

The mounting member 110 is adapted to attach to any of a variety of upright objects, such as posts, trees, columns, etc. such that the sign member 105 can also be attached to the upright object. With reference still to FIG. 2, the mounting member is a generally a planar member comprised of three regions, including a first region 128 and a pair of wings or mounting regions 130 positioned on opposite sides of the first region 128. The first region 128 is attached or attachable in a juxtaposed relationship to the back surface 125 of the sign member such that the first region 128 is fixed flat against the back surface 125 of the sign member 105.

Once the first region is attached to the sign member 105, the mounting regions 130 are free to move relative to the back surface 125. In particular, the mounting regions 130 can pivot about a pair of pivot axes 132 relative to the first region 128. The pivot axes 132 may correspond to or be aligned with opposite lateral edges of the first region 128. In an embodiment, the first region 128 is about one third of the entire surface area of the mounting member 110. The first region 128 can be attached to the back surface 125 of the mounting member 110 in a variety of manners. In an embodiment, adhesive is used to attach the first region 128 to the sign member.

In an embodiment, the first region 128 is relatively rigid while the mounting regions 130 are relatively flexible, deformable, and/or pliable. This permits the mounting regions 130 to be conformed to an irregular shaped object on which the sign system is to be mounted as well as on to flat objects.

With reference still to FIG. 1, the mounting regions 130 of the mounting member 110 are wings that are positioned on either side of the first region 128. The wings are free to move back and forth or toward and away relative to the sign member 105 and/or to pivot about respective axes 132. The mounting regions 130 are made of a material that is conformable to an irregular shape and/or are substantially non-rigid such that the mounting regions 130 can be positioned on a non-flat surface and can conform to the contour of that surface. For example, the mounting regions can be wrapped around a cylindrical surface or substantially-cylindrical surface. A back surface 206 (i.e., the surface that faces away from the sign member 105) of the mounting regions 130 includes an adhesive that is at least initially protected by a paper 207 that can be peeled off the back surface of the mounting regions 130 to expose the adhesive, as shown in FIG. 2. The front surface 205 (i.e., the surface that faces toward the sign member 105) of the mounting regions are non-adhesive in an embodiment and in another embodiment include adhesive.

In use, a user provides the front surface of the sign member 105 with graphics or wording or any other indicia for display on the sign. Advantageously, the sign member 105 is rigid such that the user can write words or graphics or even paste words or graphics on the sign member. If the sign member 105 is pre-attached to a mounting member 110, the user can then mount the sign system on an object such as a post. Otherwise, the user can attach a mounting member 110 to the back surface of a sign member 105 such as by using adhesive, which may be pre-loaded onto the sign system. The user then uses the mounting member 110 to mount the sign member 105 onto an object. Advantageously, the flexible, conformable nature of the mounting regions 130 permit the mounting regions to easily be wrapped around an object to which the sign member 105 is to be secured without deforming or otherwise disturbing the shape of the sign member.

Figure 3:
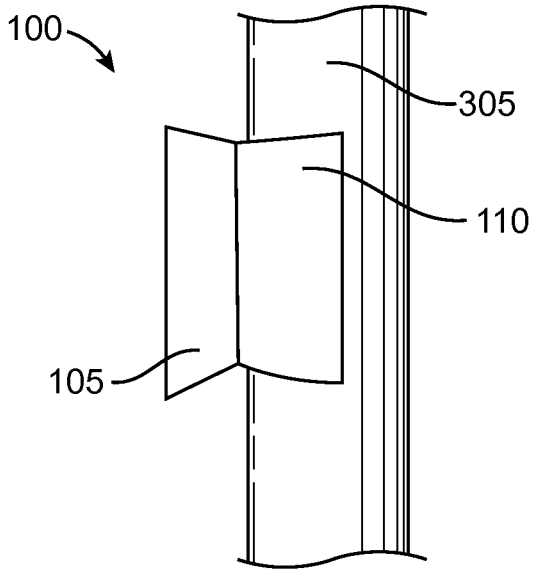
FIG. 3 shows mounting regions of the sign system wrapped around and adhered to a post of irregular shape.

For example, FIG. 3 shows the mounting regions 130 wrapped around and adhered to a post 305 of irregular shape with the sign member 105 maintaining its rectangular shape. The post 305 may be cylindrical with a circular cross-section such that its outer surface is rounded or curved. The post 305 could have any of a variety of cross-sectional shapes that may be round, curved, or formed of a series of flat surfaces, such as octagonal, pentagonal, etc. As shown in FIG. 3, the sign member 105 is maintained in its flat, natural configuration while the mounting members 110 conform to the shape of the outer surface of the post 305. That is, the mounting members 110 are wrapped around the post 305.

Figure 5:
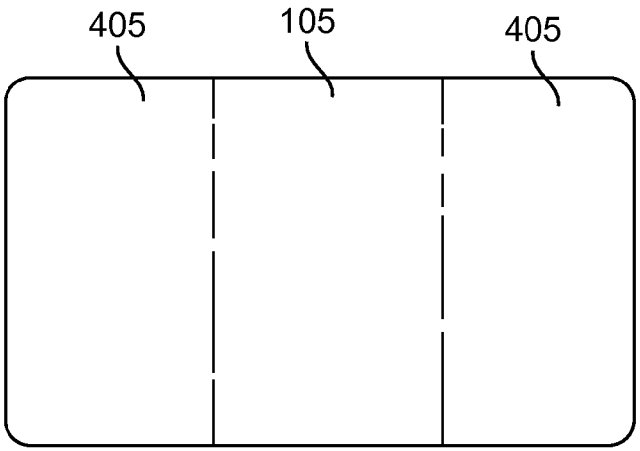
FIGS. 4-6 show a second embodiment of the system.
Figure 6:
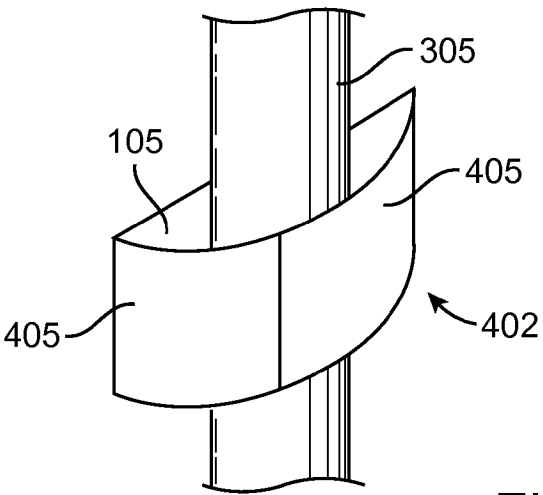
Figure 4:
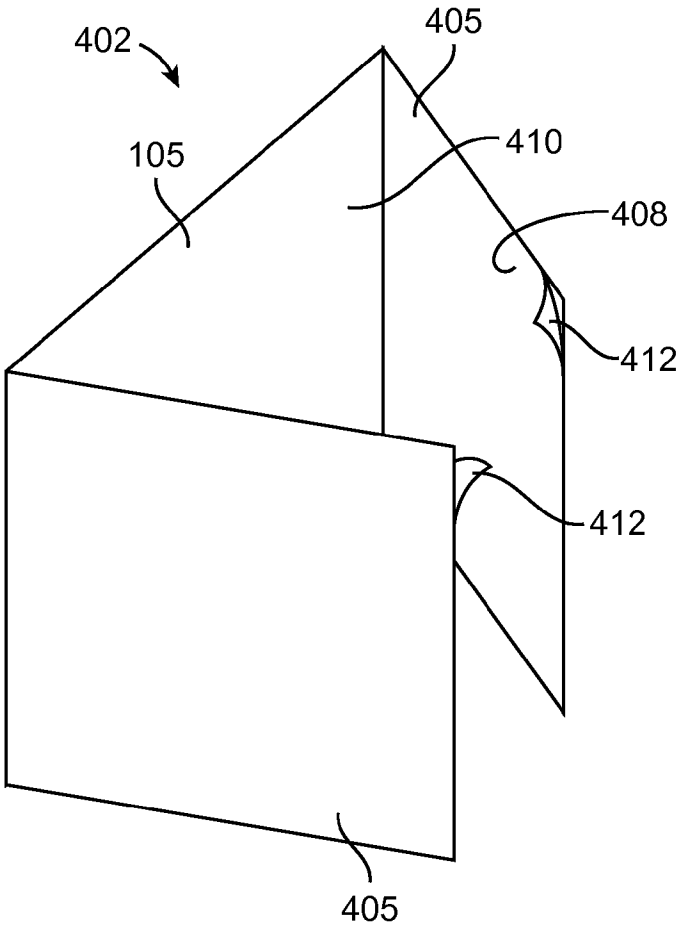

FIGS. 4-6 show another embodiment of the system 402 wherein the mounting region comprises a pair of wings 405 that are attached to the sign member 105 on opposite ends of the sign member 105. The wings 405 are flexible in nature as discussed above with reference to the mounting members 130. The wings 405 have rear surfaces 408 that are co-planar with the rear surface 410 of the sign member 105. The rear surfaces of the wings 405 are covered with a removable film 412 that can be removed to reveal an adhesive material.

In use of the embodiment of FIGS. 4-5, the removable film 412 is removed from the rear surfaces of the wings 405. The sign member 105 is then placed flat against the object to which it is to be mounted, such as a post 305 as shown in FIG. 6. The two wings 405 are then wrapped around the post 305 so that the rear surfaces of the wings 405 contact at least a portion of the outer surface of the post 305. The adhesive on the rear surfaces of the wings 405 adheres the sign system 402 to the post 305 or other object.

As will be apparent to those of skill in the art upon reading this disclosure, each of the individual embodiments described and illustrated herein has discrete components and features which may be readily separated from or combined with the features of any of the other several embodiments without departing from the scope of the subject matter described herein. Any recited method can be carried out in the order of events recited or in any other order which is logically possible.

While this specification contains many specifics, these should not be construed as limitations on the scope of an invention that is claimed or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Similarly, while operations are depicted in the drawings in a particular order, this should not be understood as requiring that such operations be performed in the particular order shown or in sequential order, or that all illustrated operations be performed, to achieve desirable results.

Although embodiments of various methods and devices are described herein in detail with reference to certain versions, it should be appreciated that other versions, embodiments, methods of use, and combinations thereof are also possible. Therefore the spirit and scope of the appended claims should not be limited to the description of the embodiments contained herein.

The invention claimed is:

1. A sign system, comprising:

a sign member formed of a rigid material of relatively fixed shape, wherein the sign member has a front surface for display of a sign and a back surface;

a mounting member attached to the back surface of the sign member, wherein the mounting member is at least partially formed of a sheet of material of conformable shape, and wherein at least a portion of the mounting member comprises adhesive, and wherein the mounting member is conformable to both a flat surface and a surface having an irregular contour;

wherein the mounting member comprises a central region and a pair of wings on opposite sides of the central region, each wing being integrally formed of the sheet of material, and wherein a rear surface of the central region is juxtaposed and attached to a rear surface of the sign member, and wherein a rear surface of each of the wings has adhesive.

2. A sign system as in claim 1, wherein the mounting member is pre-attached to the sign member.

3. A sign system as in claim 1, wherein the central region is rigid and the wings are flexible.

4. A sign system as in claim 1, wherein the mounting member is attached to the sign member through adhesive.

5. A sign system as in claim 1, wherein the mounting member is removably attached to the sign member.

6. A sign system as in claim 1, wherein the rear surfaces of the wings are covered with a removable film that can be removed to reveal the adhesive.

7. A sign system as in claim 1, wherein each wing is more flexible than the central region.

8. A sign system as in claim 1, wherein at least a portion of the mounting member can conform to the shape an irregular shaped object on which the sign system is to be mounted.

* * * * *